US005636570A

United States Patent [19]

Ebina et al.

[11] Patent Number: 5,636,570

[45] Date of Patent: Jun. 10, 1997

[54] CYLINDER CLEANING APPARATUS FOR PRINTING PRESS

[75] Inventors: Toshihiko Ebina; Toshimi Tanaka, both of Ibaragi, Japan

[73] Assignee: Komori Corporation, Tokyo, Japan

[21] Appl. No.: 540,758

[22] Filed: Oct. 11, 1995

Related U.S. Application Data

[62] Division of Ser. No. 156,105, Nov. 22, 1993, Pat. No. 5,515,782.

[30] Foreign Application Priority Data

Nov. 30, 1992 [JP] Japan ..... 4-087574 U
Mar. 15, 1993 [JP] Japan ..... 5-016854 U

[51] Int. Cl.[6] ..... B41F 35/00

[52] U.S. Cl. ..... 101/424; 101/423

[58] Field of Search ..... 101/424, 423, 101/425; 15/103.5, 104.011, 256.53, 256.52, 256.51, 256.5

[56] References Cited

U.S. PATENT DOCUMENTS 3,672,764 6/1972 Hartwig et al. ..... 15/256.52
4,832,772 5/1989 Noguchi et al. ..... 15/103.5
5,275,104 1/1994 Corrado et al. ..... 101/425

*Primary Examiner*—Edgar S. Burr
*Assistant Examiner*—Anthony H. Nguyen
*Attorney, Agent, or Firm*—Blakely Sokoloff Taylor & Zafman

[57] ABSTRACT

A cylinder cleaning apparatus for a printing press includes a cleaning cloth, a plate, and a cylinder and a rod. The cleaning cloth is brought into contact with the circumferential surface of a blanket cylinder to wipe a foreign matter on the circumferential surface of the blanket cylinder. The plate is arranged to oppose the circumferential surface of the blanket cylinder through the cleaning cloth, is deformed in accordance with a radius of curvature of the circumferential surface of the blanket cylinder, and has a reaction force against the circumferential surface of the blanket cylinder. The cylinder and the rod press the plate against the circumferential surface of the blanket cylinder, thereby bringing the cleaning cloth into contact with the circumferential surface of the blanket cylinder at a predetermined contact pressure.

4 Claims, 11 Drawing Sheets

CYLINDER CLEANING APPARATUS FOR PRINTING PRESS

This is a divisional of application Ser. No. 08/156,105, filed Nov. 22, 1993 now U.S. Pat. No. 5,515,782.

BACKGROUND OF THE INVENTION

The present invention relates to a cylinder cleaning apparatus for a printing press which presses a cleaning web against the circumferential surface of a cylinder, e.g., a printing cylinder or a roller, and wipes the circumferential surface of the cylinder with the cleaning web.

Various types of printing presses, e.g., an offset press and an intaglio printing press, have printing cylinders, e.g., a plate cylinder, a blanket cylinder, an impression cylinder, and a transfer cylinder, and rollers, e.g., a form roller and a vibrating roller, all of which serve as cylinders. During printing, foreign matters, e.g., ink dust and paper dust attach to the circumferential surfaces of these printing cylinders and rollers to degrade the quality of printed matter. Hence, the printing press is provided with a cylinder cleaning apparatus for removing the foreign matters by wiping the circumferential surfaces of the cylinders, e.g., printing cylinders and rollers with a cleaning web constituted by roll paper, an unwoven fabric, a roll cloth, or an ordinary cloth.

More specifically, U.S. Pat. No. 4,344,361 and Japanese Utility Model Laid-Open No. 3-90943 disclose examples of a cylinder cleaning apparatus of this type. The cylinder cleaning apparatus disclosed in the former gazette has a rubber bladder which is inflatable with compressed air. The bladder is inflated to press a cleaning web engaged with the bladder against a blanket cylinder, thereby cleaning the cylinder. The cleaning web is pressed against or separated from the cylinder by inflation and deflation of the bladder. The cylinder cleaning apparatus disclosed in the latter gazette has an expandable member which is expanded with compressed air. After the expandable member is expanded, a unit having the expandable member and a cleaning web mounted thereon is moved by air cylinders toward the blanket cylinder, and the cleaning web engaged with the expandable member is pressed against the blanket cylinder, thereby cleaning the blanket cylinder. The cleaning web is pressed against or separated from the cylinder by moving the unit forward and backward by activating the air cylinders.

However, since any one of the cylinder cleaning apparatuses of the prior art techniques described above uses an expandable member, it requires a sealing structure so that the compressed air will not leak when this expandable member is expanded, resulting in a complicated, expensive cylinder cleaning apparatus. When the expandable member is worn or bursts, a cumbersome repair work must be performed.

SUMMARY OF THE INVENTION

It is an object of the present invention to provide a low-cost cylinder cleaning apparatus for a printing press, which has a simple structure.

It is another object of the present invention to provide a cylinder cleaning apparatus of a printing press, which does not require a cumbersome repair work.

In order to achieve the above objects, according to the present invention, there is provided a cylinder cleaning apparatus for a printing press, comprising a cleaning web, brought into contact with a circumferential surface of a cylinder, for wiping a foreign matter on the circumferential surface of the cylinder, a belt-like member, arranged to oppose the circumferential surface of the cylinder through the cleaning web, deformed in accordance with a radius of curvature of the circumferential surface of the cylinder, and having a reaction force against the circumferential surface of the cylinder, and pressing means for pressing the belt-like member against the circumferential surface of the cylinder, thereby bringing the cleaning web into contact with the circumferential surface of the cylinder at a predetermined contact pressure.

DESCRIPTION OF THE PREFERRED EMBODIMENTS

Figure 1:
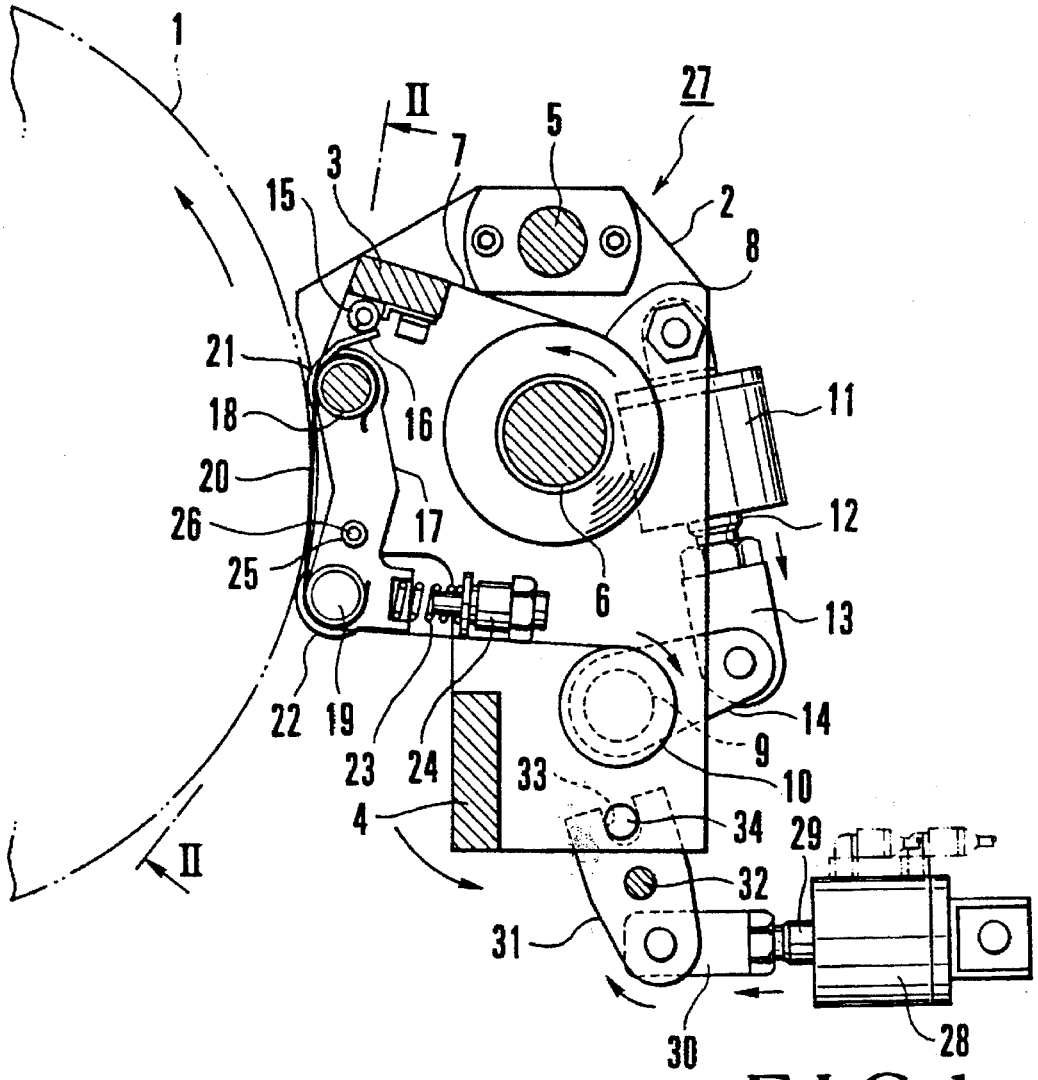
FIG. 1 is a side view showing a cylinder cleaning apparatus for a printing press according to the first embodiment of the present invention.
Figure 2:
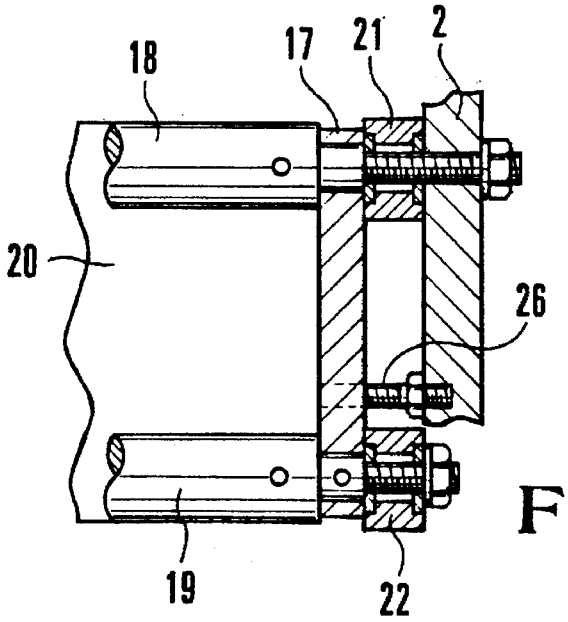
FIG. 2 is a sectional view taken along the line II—II of FIG. 1.

The preferred embodiments of the present invention will be described with reference to the accompanying drawings. FIG. 1 is a side view of a cylinder cleaning apparatus for a printing press according to the first embodiment of the present invention, and FIG. 2 is a side view taken along the line II—II. Referring to FIGS. 1 and 2, reference numeral 1 denotes a blanket cylinder opposing to contact an impression cylinder (not shown). The blanket cylinder 1 is movable toward the impression cylinder in accordance with the thickness of paper. Reference numeral 2 denotes a pair of side frames opposing the two ends of stays 3 and 4 that extend parallel to the shaft of the blanket cylinder 1. The upper end portions of the side frames 2 are pivotally supported by pins 5 extending from frames (not shown) so that the side frames 2 can swing. Reference numeral 6 denotes a cloth supply shaft 6 pivotally supported by the side frames 2. A cleaning cloth 7 serving as the cleaning web is wound on the cloth supply shaft 6 to constitute a cleaning cloth supply roll 8. Reference numeral 9 denotes a cloth take-up shaft pivotally supported by the side frames 2. The cleaning cloth 7 supplied from the cleaning cloth supply roll 8 is taken up by the cloth take-up shaft 9 to constitute a cleaning cloth take-up roll 10. The cleaning cloth 7 running from the cleaning cloth supply roll 8 to the cleaning cloth take-up roll 10 is guided by the stay 3 and a plate 20 (to be described later) serving as a pressing member and brought into contact with the circumferential surface of the blanket cylinder 1.

Reference numeral 11 denotes air cylinders 11 each having one end pivotally mounted on the corresponding side frame 2. A piston rod 12 of each air cylinder 11 is coupled to a corresponding lever 13, and the lever 13 is coupled to the swinging end portion of a corresponding lever 14 which is coaxially swingably supported by the cloth take-up shaft 9. The levers 14 and the cloth take-up shaft 9 are connected to each other through one-way clutches (not shown) so that the cloth take-up shaft 9 is pivoted by the swinging operation of the levers 14 only in a direction to take up the cleaning cloth 7.

Reference numeral 15 denotes a spray nozzle fixed to the stay 3 for injecting a cleaning liquid. The cleaning liquid injected from the spray nozzle 15 is diffused by a reflection plate 16 to be sprayed on the cleaning cloth 7. Reference numeral 17 denotes substantially V-shaped plate holding levers constituting a pair. The pair of plate holding levers 17 are provided close to the circumferential surface of the blanket cylinder 1 to oppose the side frames 2. Plate holding shafts 18 and 19 horizontally extend between the upper and lower end portions of the plate holding levers 17. The upper plate holding shaft 18 is pivotally supported by the side frames 2, and the plate holding levers 17 are supported such that their lower end sides can swing about the plate holding shaft 18 as the center. A plate 20 constituted by a flexible steel plate and having substantially the same width as that of the blanket cylinder 1, i.e., the length of the blanket cylinder 1 in the axial direction, extends between the plate holding shafts 18 and 19 in the direction tangent to the circumferential surface of the blanket cylinder 1, such that it opposes to contact the circumferential surface of the blanket cylinder 1. Hook portions each having a U-shaped section are formed on the two ends of the plate 20. The plate 20 is held by the plate holding levers 17 as their U-shaped hook portions are caught by the plate holding shafts 18 and 19.

Rollers 21 and 22 having diameters slightly larger than those of the plate holding shafts 18 and 19 are coaxially mounted on the plate holding shafts 18 and 19 to be rotatable. The rollers 21 and 22 abut against bearers (not shown) disposed on the two ends of the blanket cylinder 1 and serve as stoppers when a cleaning unit 27 (to be described later) moves toward the blanket cylinder 1, i.e., moves in a direction to come close to the circumferential surface of the blanket cylinder 1. Compression springs 23 are interposed between the lower end portions of the plate holding levers 17 opposite to the blanket cylinder 1 and spring holders 24 fixed to the side frames 2. The compression springs 23 have a spring force larger than the elastic force of the flexible plate 20, and serve as pressing means for pressing the plate 20 toward the blanket cylinder 1. An swinging tendency is imparted to the plate holding levers 17 by the compression springs 23 so that the plate holding levers 17 swing clockwise in FIG. 1 about the plate holding shaft 18 as the center. A hole 25 is formed at a lower central portion of each plate holding lever 17, and a pin 26 having a diameter smaller than the hole 25 and extending from the corresponding side frame 2 is freely fitted in the hole 25 to regulate the swinging range of the plate holding lever 17. More specifically, the plate holding levers 17 can swing only by an amount corresponding to a gap of the holes 25 and the pins 26. In the initial state of the cleaning unit 27, the plate holding levers 17 biased by the compression springs 23 wait at positions where the edge portions of the holes 25 abut against the pins 26. In this state, the lower end portions of the plate holding levers 17 slightly project from the lower end portion of the cleaning unit 27 toward the blanket cylinder 1. Hence, when the cleaning unit 27 is moved, the rollers 22 and 21 abut against the bearers of the blanket cylinder 1 in the order named. The pins 26 fitted in the holes 25 serve also as stoppers that regulate the plate holding levers 17 from being swung by the compression springs 23 toward the blanket cylinder 1 more than necessary when the cleaning unit 27 (to be described later) moves apart from the blanket cylinder 1.

The cloth supply shaft 6, the cloth take-up shaft 9, the air cylinders 11, the spray nozzle 15, the plate 20, and the like are mounted to the side frames 2 to constitute the cleaning unit 27. Reference numeral 28 denotes air cylinders. A distal end member 30 of a piston rod 29 of each air cylinder 28 is coupled to one end of a lever 31 which is swingably supported by a support pin 32 extending from the frame (not shown). A U-shaped groove 33 formed in the other end of each lever 31 is engaged with a pin 34 extending from the lower portion of the corresponding side frame 2.

The cleaning operation of the cleaning apparatus for the printing press which has the arrangement described above will be described. When the cleaning operation is started, a solvent is injected from the spray nozzle 15. The injected solvent is sprayed on the cleaning cloth 7 by the reflection plate 16. The spray nozzle 15 may inject the solvent directly to the circumferential surface of the blanket cylinder 1, or to a brush roller (not shown) opposing to contact the circumferential surface of the blanket cylinder 1. In the state wherein the cleaning unit 27 is kept separated from the circumferential surface of the blanket cylinder 1, the air cylinders 28 are activated to retract the piston rods 29. Then, the levers 31 are pivoted counterclockwise through the distal end members 30 about the support pins 32 as the center, so that the cleaning unit 27 swings clockwise through the pins 34 about the support pins 5 as the center, thereby moving toward the blanket cylinder 1, i.e., moving in a direction to come close to the circumferential surface of the blanket cylinder 1. At this time, in the initial stage of movement of the cleaning unit 27, the rollers 22 slightly projecting from the lower end portion of the cleaning unit 27 are first abutted against the bearers by the biasing force of the compression springs 23. Then, the cleaning unit 27 is moved against the biasing force of the compression springs 23 in accordance with a play with respect to the plate holding levers 17. In the final stage of movement, when the rollers 21 are abutted against the bearers, movement of the cleaning unit 27 is stopped. At this time point, the piston rods 29 have not been retracted completely but are left with some margin.

In this state, the cleaning cloth 7 guided by the plate 20 is brought into contact with the circumferential surface of the blanket cylinder 1. Then, the plate 20 flexes along the circumferential surface of the blanket cylinder 1 to generate a reaction force. Cleaning is performed at appropriate contact pressure and width which are obtained by the flexing force of the plate 20. During cleaning of the blanket cylinder 1, the air cylinders 11 are activated to intermittently draw a new portion of the cleaning cloth 7 from the cleaning cloth supply roll 8. Simultaneously, the soiled portion of the cleaning cloth 7 is taken up by the cleaning cloth take-up roll 10. During cleaning, the solvent is injected from the spray nozzle 15 to the cleaning cloth 7 at, e.g., a predetermined interval. When injection of the solvent is stopped and cleaning with the solvent is ended, the circumferential surface of the blanket cylinder 1 is dry-wiped with a dry portion of the cleaning cloth 7 which is not wet with the solvent. When the circumferential surface of the blanket cylinder 1 which has been dry-wiped is almost dried, the drawing and take-up operations of the cleaning cloth 7 by the cleaning cloth supply roll 8 and the cleaning cloth take-up roll 10 are stopped. Thereafter, the air cylinders 28 are operated to move the piston rods 29 forward, the side frames 2 are thus pivoted counterclockwise about the support pins 5 as the center, and the cleaning unit 27 is separated from the circumferential surface of the blanket cylinder 1, thereby ending the cleaning operation. In this state, the plate holding levers 17 are biased by the compression springs 23 to swing toward the blanket cylinder 1, thereby restoring the initial state.

As described above, according to the first embodiment, the cleaning cloth 7 is pressed against the circumferential surface of the blanket cylinder 1 not by expanding an expandable member with compressed air, as in the prior art technique, but with the flexing force of the plate 20. Therefore, the structure is simple and inexpensive. In addition, wear, burst, air leakage, and the like of an expandable member do not occur unlike in the prior art technique, eliminating the necessity of a cumbersome repair work. Even when the impression throw off position of the blanket cylinder 1 is changed in accordance with a change in paper thickness, cleaning is performed by the cleaning cloth 7 pressed by the plate 20 while the rollers 21 and 22 are abutted against the bearers. Thus, the contact pressure and contact width of the cleaning cloth 7 with respect to the blanket cylinder 1 do not change, thereby obtaining a predetermined cleaning power. In this embodiment, the rollers 21 and 22 to be abutted against the bearers are merely pivotally coaxially supported on the plate holding shafts 18 and 19 that hold the plate 20. However, if the rollers 21 and 22 have eccentric shafts, apart from the plate holding shafts 18 and 19, the projecting amounts of the rollers 21 and 22 toward the blanket cylinder 1 can be changed, thereby adjusting the contact pressure and contact width of the cleaning cloth 7 with respect to the circumferential surface of the blanket cylinder 1.

Figure 3:
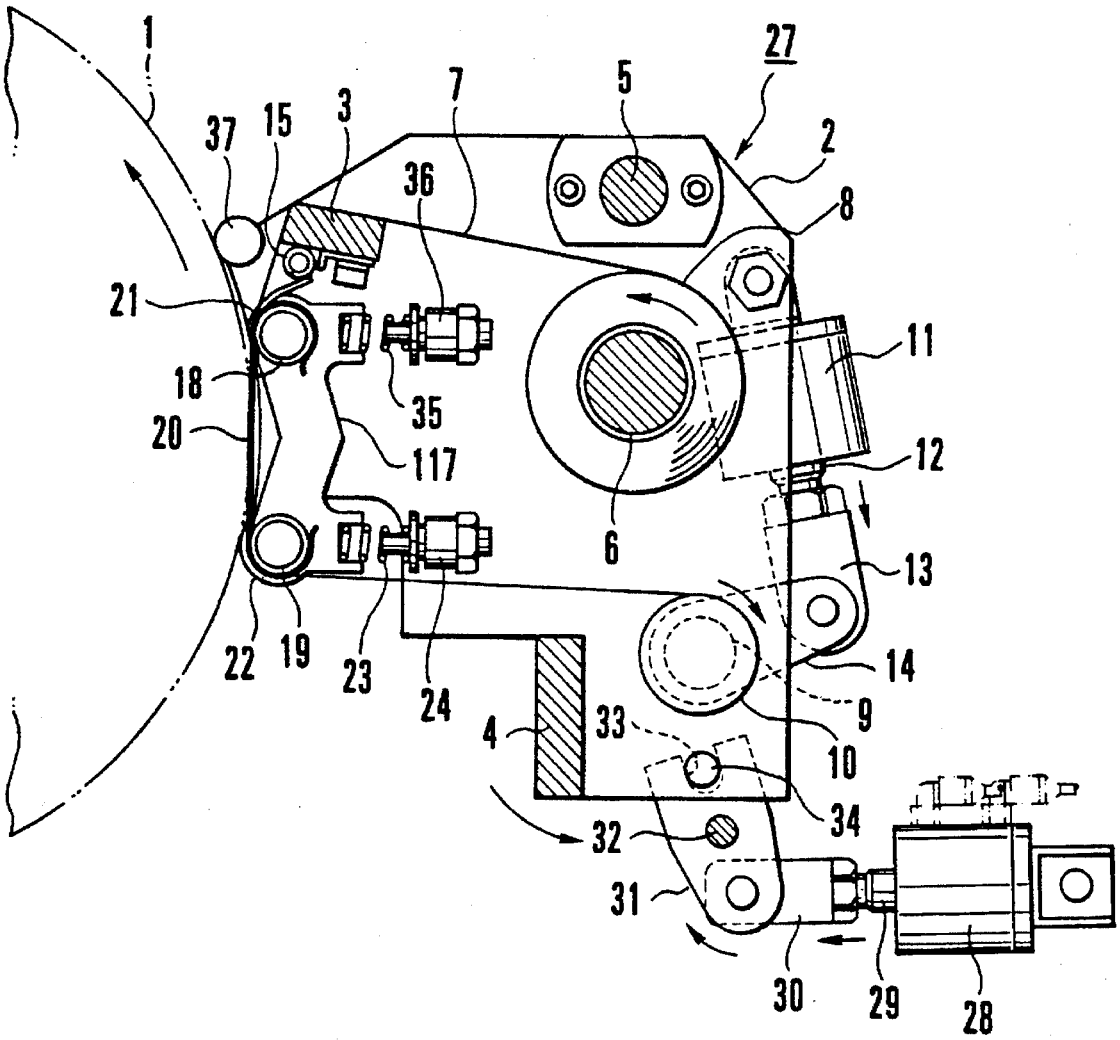
FIG. 3 is a side view showing a cylinder cleaning apparatus for a printing press according to the second embodiment of the present invention.

FIG. 3 is a side view showing a cylinder cleaning apparatus according to the second embodiment of the present invention. The same portions as in FIG. 1 are denoted by the same reference numerals, and a detailed description thereof will be omitted. In the second embodiment, each of a pair of compression springs 23 is interposed between one end of a corresponding plate holding lever 117 and a corresponding one of a pair of spring holders 24, and each of a pair of compression springs 35 is interposed between the other end of the corresponding plate holding lever 117 and a corresponding one of a pair of spring holders 36. The pair of plate holding levers 117 serve to extend a plate 20 therebetween, and the pairs of spring holders 24 and 36 are fixed to side frames 2. The pair of compression springs 23 and the pair of compression springs 35 press the upper and lower end portions of the plate holding levers 117 against the blanket cylinder 1. A plate holding shaft 18 is free from the side frames 2, and the plate holding levers 117 are held by only the compression springs 23 and 35. In the initial state of a cleaning unit 27, the two ends of the plate 20 having the same shape as that shown in FIG. 1 are fixed to the plate holding shafts 18 and 19 for the plate holding levers 117 so that the entire plate 20 slightly projects from the cleaning unit 27 toward the blanket cylinder 1. Rollers 37 for abutting against the bearers of the blanket cylinder 1 are pivotally supported at the upper portions of the side frames 2.

In the above arrangement, in order to perform cleaning, air cylinders 28 are activated to move the cleaning unit 27 toward the blanket cylinder 1 about support pins 5 as the center. More specifically, in the initial stage of movement of the cleaning unit 27, rollers 21 and 22 are abutted against the bearers, and the cleaning unit 27 is moved toward the blanket cylinder 1 against the biasing force of the compression springs 23 and 35. In the final stage of movement, when the rollers 37 are abutted against the bearers, movement of the cleaning unit 27 is stopped. In this state, a cleaning cloth 7 guided by the plate 20 is brought into contact with the circumferential surface of the blanket cylinder 1, and cleaning is performed at appropriate contact pressure and width which are obtained by the flexing force of the plate 20. If the rollers 37 have eccentric shafts, the final contact pressure and width of the cleaning cloth 7 with respect to the circumferential surface of the blanket cylinder 1 can be adjusted.

Figure 4:
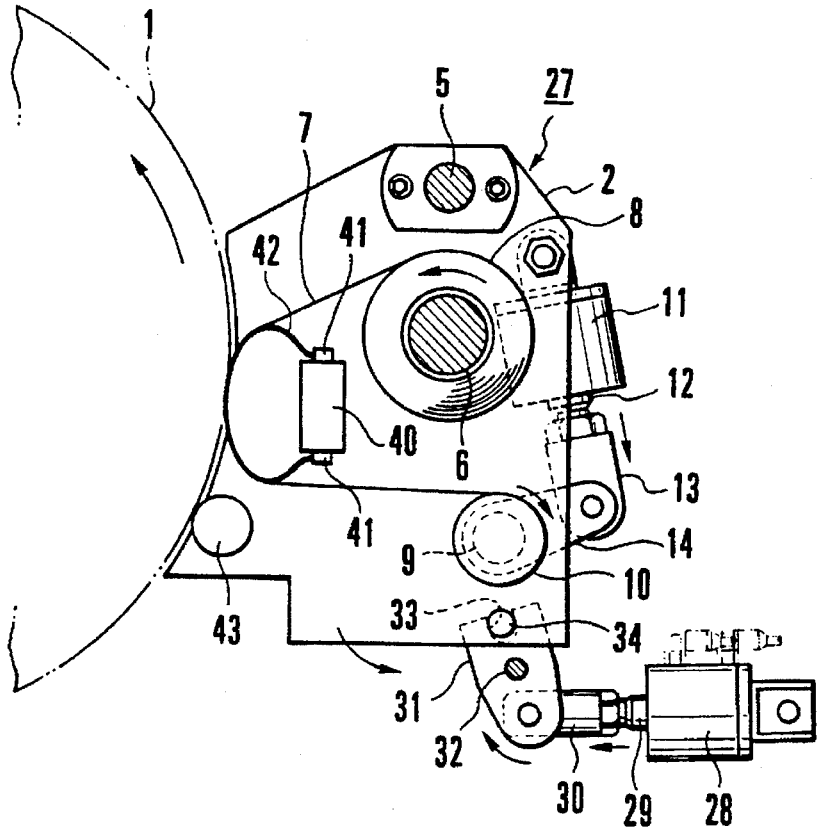
FIG. 4 is a side view showing a cylinder cleaning apparatus for a printing press according to the third embodiment of the present invention.

FIG. 4 is a side view showing a cylinder cleaning apparatus according to the third embodiment of the present invention. The same portions as in FIG. 1 are denoted by the same reference numerals, and a detailed description thereof will be omitted. In the third embodiment, a bracket 40 is fixed to the central portions of side frames 2 to be closer to a blanket cylinder 1 and substantially parallel to the direction of tangent to the circumferential surface of the blanket cylinder 1. Two ends of an elastic plate 42 are mounted to the two ends of the bracket 40 with bolts 41. The plate 42 is arcuatedly bent so as to slightly project toward the blanket cylinder 1. A cleaning cloth 7 is stretched along the circumferential surface of the plate 42. Rollers 43 abutted against the bearers of the blanket cylinder 1 are pivotally supported at the lower portions of the side frames 2. With this arrangement, in order to perform cleaning, air cylinders 28 are activated to move a cleaning unit 27 toward the blanket cylinder 1 about support pins 5 as the center. Then, the plate 42 which is flexed to be bent is abutted against the blanket cylinder 1. When the cleaning unit 27 is further moved, the cleaning cloth 7 is brought into contact with the circumferential surface of the blanket cylinder 1 at appropriate contact pressure and width by the flexing force of the plate 42 itself. Then, when the rollers 43 are abutted against the bearers, movement of the cleaning unit 27 is stopped. Note that if the rollers 43 have eccentric shafts, the contact pressure and width of the cleaning cloth 7 can be adjusted.

Figure 5:
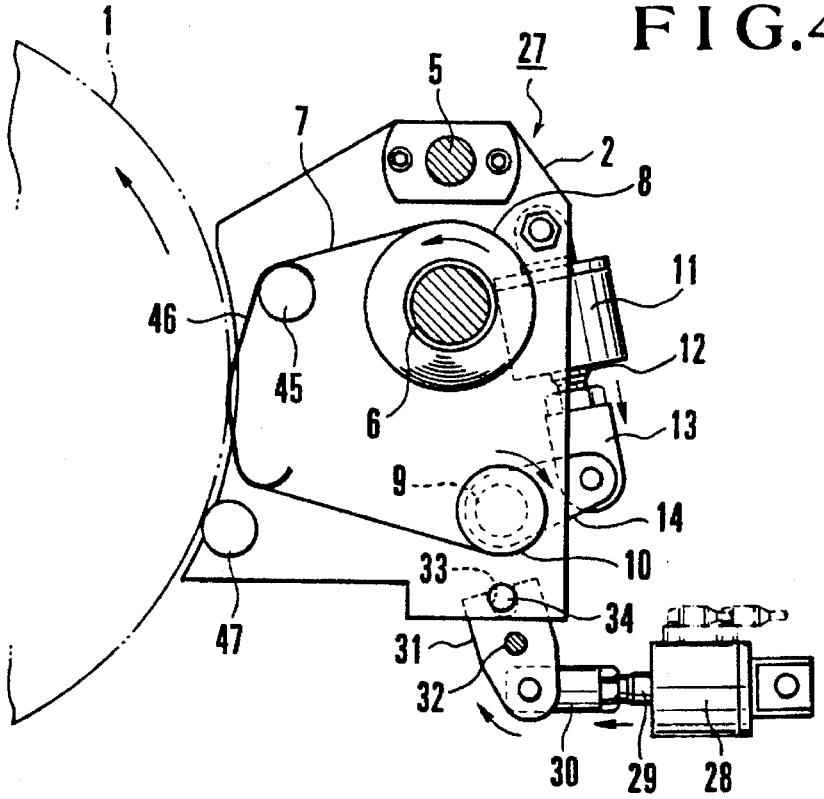
FIG. 5 is a side view showing a cylinder cleaning apparatus for a printing press according to the fourth embodiment of the present invention.

FIG. 5 is a side view showing a cylinder cleaning apparatus according to the fourth embodiment of the present invention. The same portions as in FIG. 1 are denoted by the same reference numerals, and a detailed description thereof will be omitted. In the fourth embodiment, a support shaft 45 is supported between circumferential surface of a blanket cylinder 1 at the upper portions of side frames 2, and a cleaning cloth supply shaft 6. A slightly bent plate 46 has U-shaped hook portions at its two end portions. The hook portion at the upper end portion of the plate 46 is supported by the support shaft 45 in the cantilever manner, thereby fixing the plate 46 to the support shaft 45. The bent portion of the plate 46 substantially projects toward the circumferential surface of the blanket cylinder 1. A cleaning cloth 7 is stretched on the plate 46. Rollers 47 abutted against the bearers of the blanket cylinder 1 are pivotally supported at the lower portions of the side frames 2. With this arrangement, in order to perform cleaning, air cylinders 28 are activated to move a cleaning unit 27 toward the blanket cylinder 1 about support pins 5 as the center. Then, the plate 46 is abutted against the blanket cylinder 1. When the cleaning unit 27 is further moved, the cleaning cloth 7 is brought into contact with the circumferential surface of the blanket cylinder 1 at appropriate contact pressure and width by the elastic force of the plate 46 about the support shaft 45 as the center. When the rollers 47 are abutted against the bearers, movement of the cleaning unit 27 is stopped. Note that if the rollers 47 have eccentric shafts, the contact pressure and width of the cleaning cloth 7 can be adjusted.

Figure 6:
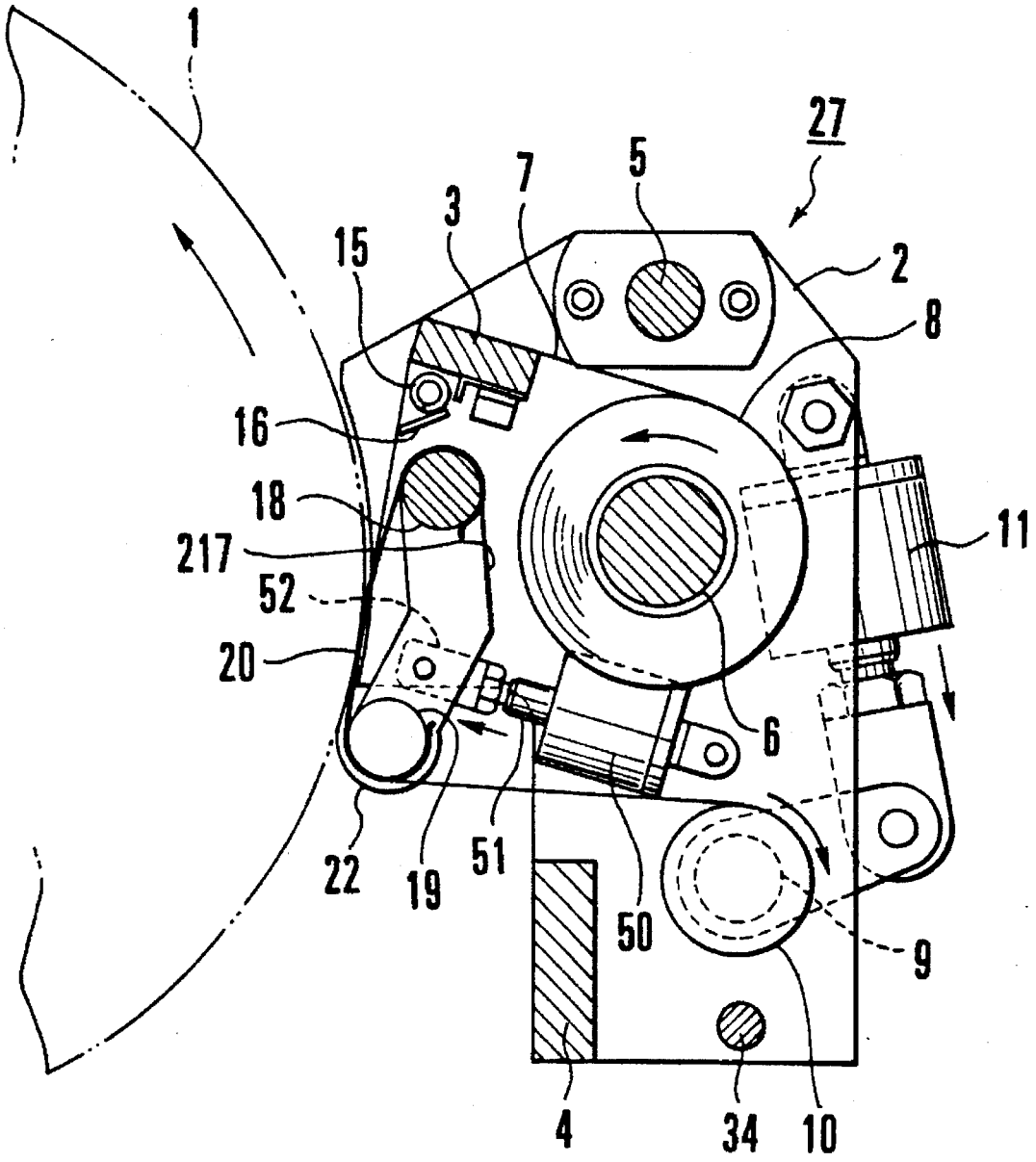
FIG. 6 is a side view showing a cylinder cleaning apparatus for a printing press according to the fifth embodiment of the present invention.

FIG. 6 is a side view showing a cylinder cleaning apparatus according to the fifth embodiment of the present invention. The same portions as in FIG. 1 are denoted by the same reference numerals, and a detailed description thereof will be omitted. In the fifth embodiment, support pins 5 of side frames 2 and pins 34 extend horizontally between frames (not shown), and a cleaning unit 27 is fixed to the frames. Plate holding levers 217 are swingably supported by a plate holding shaft 18, and air cylinders 50 are mounted to the side frames 2. Distal end members 52 of piston rods 51 of the air cylinders 50 are coupled to the lower portions of plate holding levers 217. The two ends of a plate 20 are fixed to plate holding shafts 18 and 19 in the same manner as in FIG. 1.

In this embodiment, when cleaning is to be performed, the air cylinders 50 are activated to move the piston rods 51 forward, so that the plate holding levers 217 are pivoted clockwise about the plate holding shaft 18 as the center. Hence, the plate 20 is pressed against the circumferential surface of a blanket cylinder 1, thereby performing cleaning. In this embodiment as well, even when the impression throw off position of the blanket cylinder 1 is changed in accordance with a change in paper thickness, the piston rods 51 move forward until rollers 22 contact to press the plate 20 against the circumferential surface of the blanket cylinder 1. Therefore, the cleaning cloth 7 can be abutted against the circumferential surface of the blanket cylinder 1 at appropriate contact pressure and width. If the rollers 22 have eccentric shafts, the contact pressure and width of the cleaning cloth 7 can be adjusted.

Figure 7:
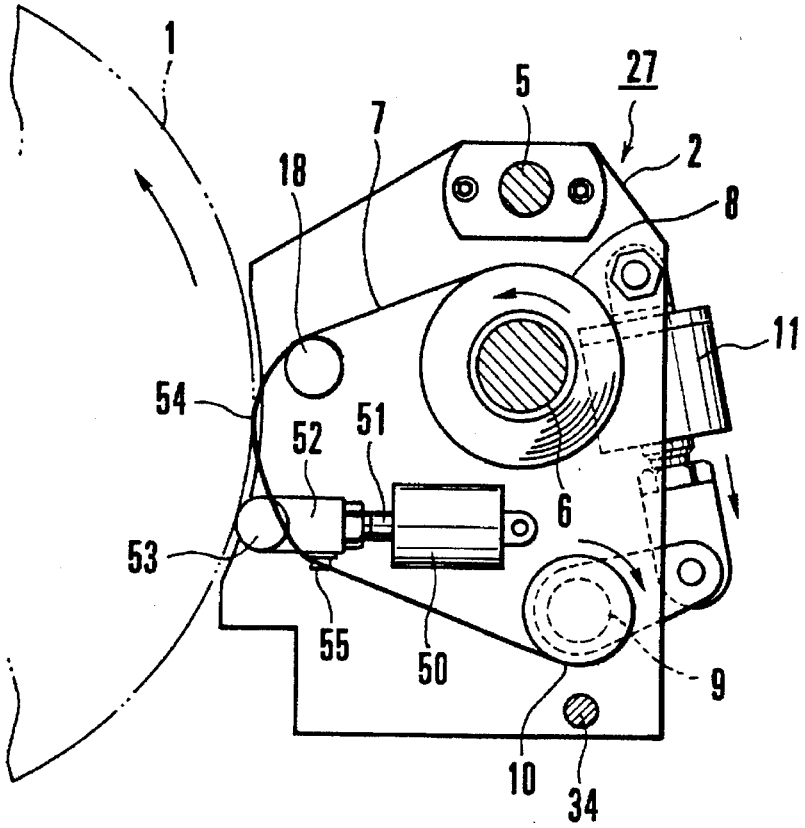
FIG. 7 is a side view showing a cylinder cleaning apparatus for a printing press according to the sixth embodiment of the present invention.

FIG. 7 is a side view showing a cylinder cleaning apparatus according to the sixth embodiment of the present invention. The same portions as in FIG. 1 are denoted by the same reference numerals, and a detailed description thereof will be omitted. In the sixth embodiment, air cylinders 50 are horizontally mounted on fixed side frames 2, and rolls 53 are pivotally supported on the distal ends of distal end members 52 fixed to piston rods 51 of the air cylinders 50. The upper end portion of a plate 54 which is arcuatedly bent and has a flexing force is mounted to a plate holding shaft 18, and the lower end portion of the plate 54 is mounted to the distal end members 52 through bolts 55. When the cleaning operation is to be performed, the air cylinders 50 are activated to move the piston rods 51 forward, so that the plate 54 is pressed against the circumferential surface of a blanket cylinder 1. When the rollers 53 are abutted against the bearers, operation of the air cylinders 50 is stopped. A cleaning cloth 7 cleans the circumferential surface of the blanket cylinder 1 by the pressing force against the plate 54. If the rolls 53 have eccentric shafts and are pivotally supported by the distal end members 52, the contact pressure and width of the cleaning cloth 7 can be adjusted.

Figure 8:
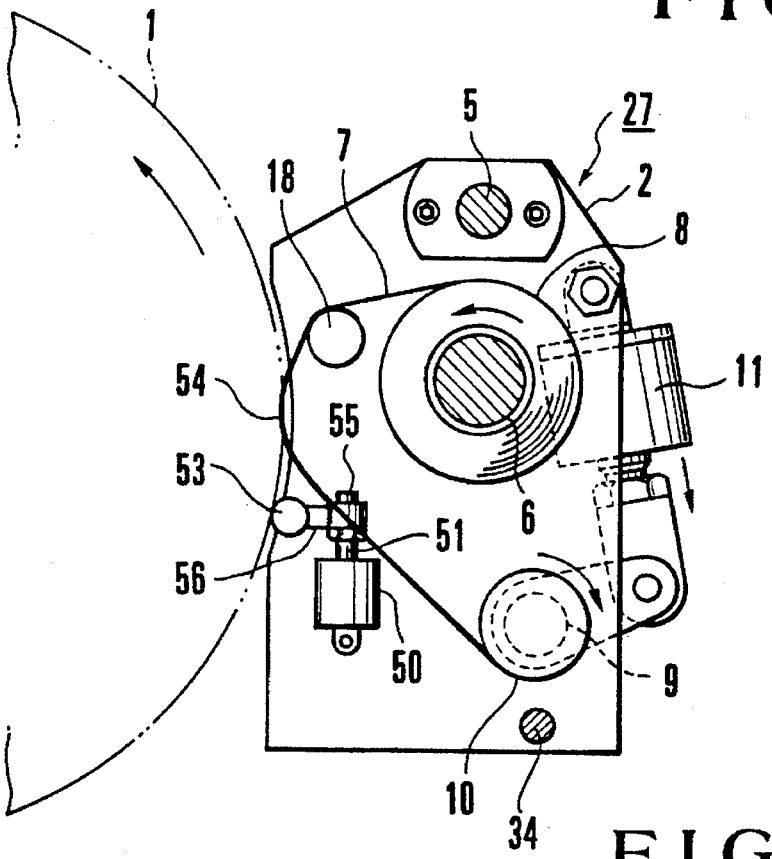
FIG. 8 is a side view showing a cylinder cleaning apparatus for a printing press according to the seventh embodiment of the present invention.

FIG. 8 is a side view showing a cylinder cleaning apparatus according to the seventh embodiment of the present invention. The same portions as in FIG. 1 are denoted by the same reference numerals, and a detailed description thereof will be omitted. In the seventh embodiment, air cylinders 50 are vertically mounted to fixed side frames 2 such that their piston rods 51 face upward. Distal end members 56 are vertically mounted to the piston rods 51, and rollers 53 to be abutted against bearers are pivotally supported on the distal ends of the distal end members 56. When the cleaning operation is to be performed, the air cylinders 50 are activated to move the piston rods 51 forward, so that a plate 54 is flexed to be pressed against the circumferential surface of a blanket cylinder 1. When the rollers 53 are abutted against the bearers, the operation of the air cylinders 50 is stopped. If the rollers 53 have eccentric shafts and are pivotally supported by the distal end members 56, the contact pressure and width of a cleaning cloth 7 can be adjusted.

Figure 9:
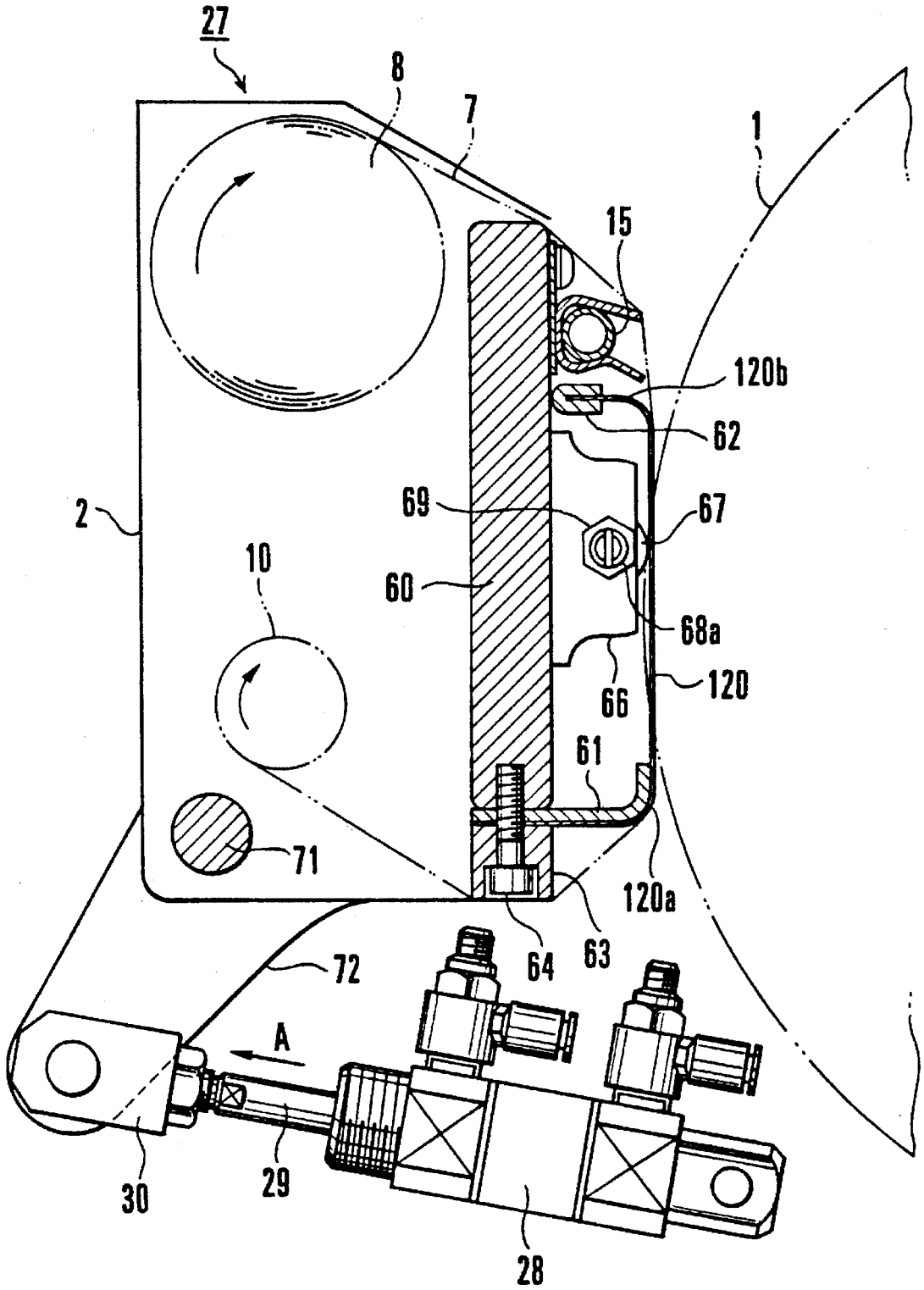
FIG. 9 is a side view showing a cylinder cleaning apparatus for a printing press according to the eighth embodiment of the present invention.
Figure 10:
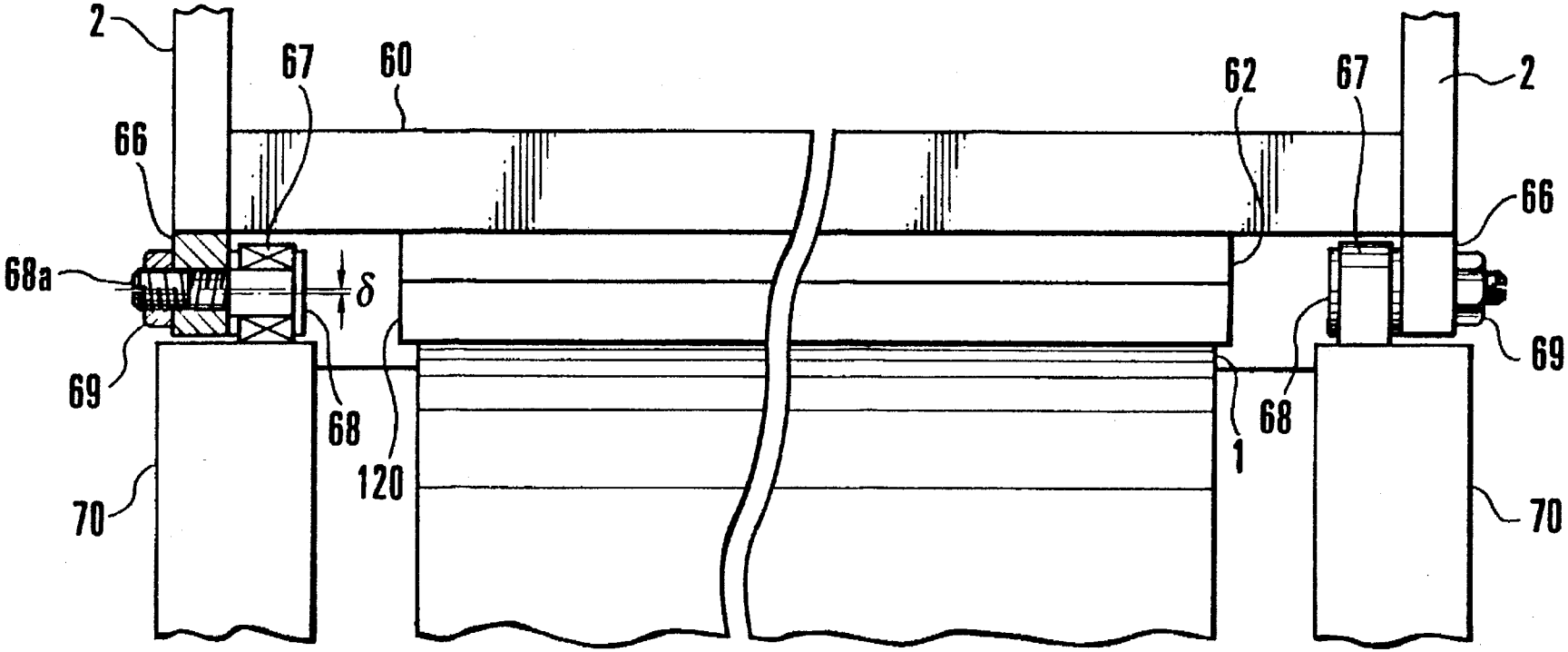
FIG. 10 is a plan view showing the cylinder cleaning apparatus for a printing press according to the eighth embodiment of the present invention.
Figure 11A:
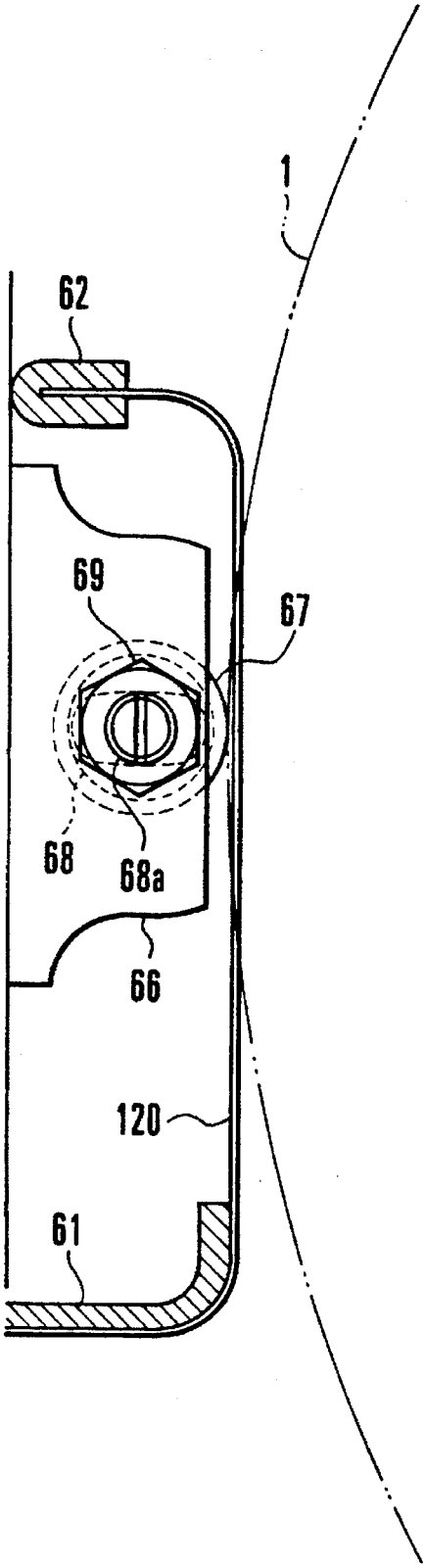
FIGS. 11A and 11B are side views showing the operating state of the main part of the cylinder cleaning apparatus for a printing press according to the eighth embodiment of the present invention.
Figure 11B:
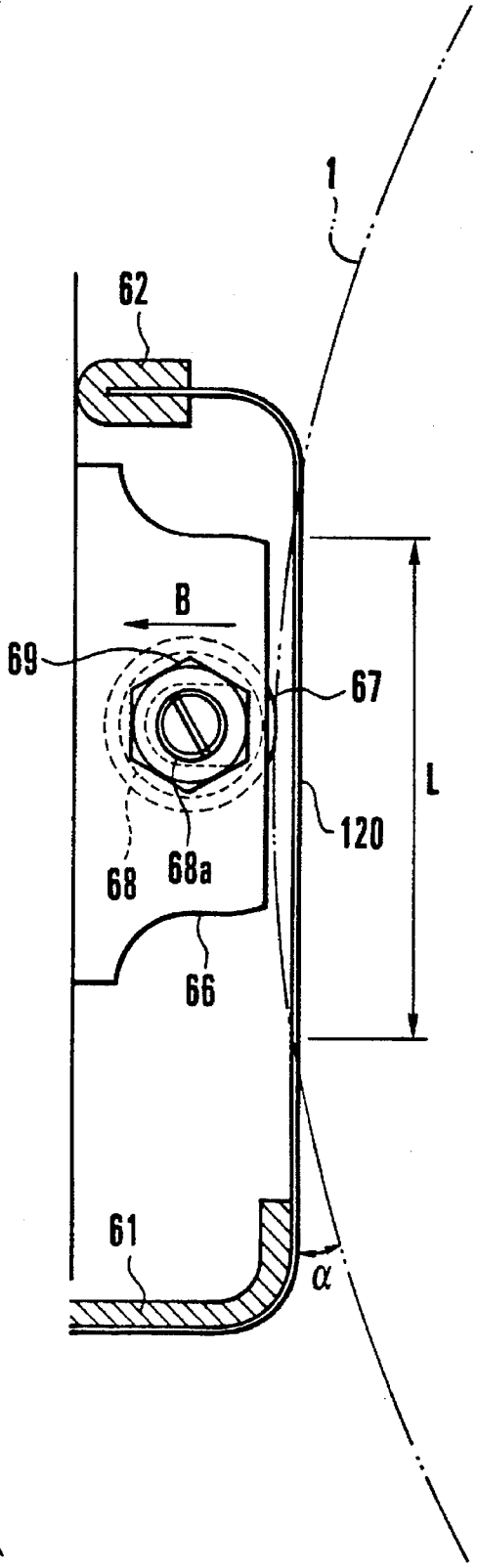

FIGS. 9, 10, 11A, and 11B show a cylinder cleaning apparatus according to the eighth embodiment of the present invention, in which FIGS. 9 and 10 show the structure of the cylinder cleaning apparatus, and FIGS. 11A and 11B show the operation of the apparatus. The same portions as in FIG. 1 are denoted by the same reference numerals, and a detailed description thereof will be omitted. In FIGS. 9, 10, 11A, and 11B, two ends of a plate 120 are bent at a right angle. A buffer member 61 for preventing destruction caused by repeated bending fatigue is adhered to the rear surface of one bent portion 120*a*, and a rubber member 62 is attached to the distal end of the other bent portion 120*b*. The bent portion 120*a* of the plate 120 is mounted to a stay 60 through a mounting member 63 and bolts 64 together with the buffer member 61, so that the rubber member 62 is abutted against the surface of the square stay 60 horizontally extending between side frames 2.

Support tables 66 each having a substantially trapezoidal side section are provided on the end portions of the side frames 2 at the blanket cylinder 1 side, and flanged pins 68 each having a threaded portion 68*a* at its one end are pivotally axially supported by the support tables 66. Of each pin 68, the threaded portion 68*a* and the main portion for rotatably supporting a corresponding roller 67 are decentered by δ. The pins 68 are mounted to the side frames 2 by engaging nuts 69 with the threaded portions 68*a*, and the rollers 67 oppose bearers 70 at two ends of the blanket cylinder 1. A cleaning unit 27 is supported to be swingable about fulcrum pins 71 extending from frames (not shown) as the center. One end of each of lever portions 72 integrally formed at the lower ends of the side frames 2, on which the cleaning unit 27 is mounted, is pivotally supported by a distal end member 30 of a piston rod 29 of the corresponding air cylinder 28.

The operation of the cleaning apparatus for a printing press which has an arrangement as described above will be described. In order to perform the cleaning operation, the air cylinders 28 are activated to move the piston rods 29 forward in a direction indicated by an arrow A. Then, the cleaning unit 27 is pivoted clockwise in FIG. 9 together with the lever portions 72 about the fulcrum pins 71 as the center. The plate 120 is pressed against the circumferential surface of the blanket cylinder 1 by this pivotal movement. When the rollers 67 are abutted against the bearers 70, the cleaning unit 27 stops its pivotal movement, and the cleaning operation is started. If the contact pressure and width of a cleaning cloth 7 with the blanket cylinder 1 need be adjusted, the threaded portions 68*a* of the pins 68 are pivoted. Then, since the pins 68 are eccentric, the rollers 67 are moved toward or retracted from the bearers 70. More specifically, when the pins 68 are pivoted from the state of FIG. 11A, the rollers 67 are retracted from the bearers 70, as indicated by an arrow B in FIG. 11B, and the plate 120 is moved toward the blanket cylinder 1 by an amount corresponding to the retracting distance of the rollers 67. Hence, the contact pressure of the cleaning cloth 7 against the blanket cylinder 1 is increased, and a contact length L of the cleaning cloth 7 with the blanket cylinder 1 in the direction tangent to the blanket cylinder 1 is increased.

Simultaneously, a contact angle $\alpha$ defined by the plate 120 and the surface of the blanket cylinder 1 is decreased, and hence the residual ink and cleaning liquid can be absorbed well by the cleaning cloth 7. In a conventional structure in which the cleaning cloth is pressed by an expandable member, since the surface of the expandable member is arcuated, the angle of relief at the two ends of the expandable member with respect to the blanket cylinder is increased, thereby increasing the contact angle. When the contact angle is increased in this manner, the residual ink and cleaning liquid cannot be completely absorbed by the cleaning cloth, so that liquid drops can be undesirably formed easily.

In this embodiment, the buffer member 61 and the rubber member 62 are provided in order to prevent the bent portions 120*a* and 120*b* at the two ends of the plate 120 from being destroyed by fatigue when the plate 120 is repeatedly pressed against the blanket cylinder 1. If these bent portions at the two ends are supported from the rear surface, e.g., if a support member is provided to the stay 60 or the side frames 2 for supporting the rear surfaces of the bent portions 120*a* and 120*b* at the two ends of the plate 120, or if a support member having an elastic force is employed, the durability of the plate 120 can be maintained without providing the buffer member 61 or rubber member 62.

In all the embodiments described above, the plate 120 constituted by a steel plate is used as a member for pressing the cleaning cloth 7 against the circumferential surface of the blanket cylinder 1. However, the present invention is not limited to this, and a molded product made of a synthetic resin may be used instead. Any member can be used as far as it is flexible, as a matter of course. The shape of the plate 120 as the pressing member for pressing the cleaning cloth 7 against the circumferential surface is a flat plate. However, the present invention is not limited to a flat plate-like pressing member, but various design changes and modifications are possible. The plate 120 may be constituted by one plate, as in this embodiment, or can be constituted by a plurality of divisional plates. For example, when the plate 120 is to be divided into a plurality of plates, if the plate 120 is divided into round slices along the axial direction of the blanket cylinder 1, the distribution of the pressing force can be easily changed by changing the flexing amounts of the individual divisional plates.

Figure 12A:
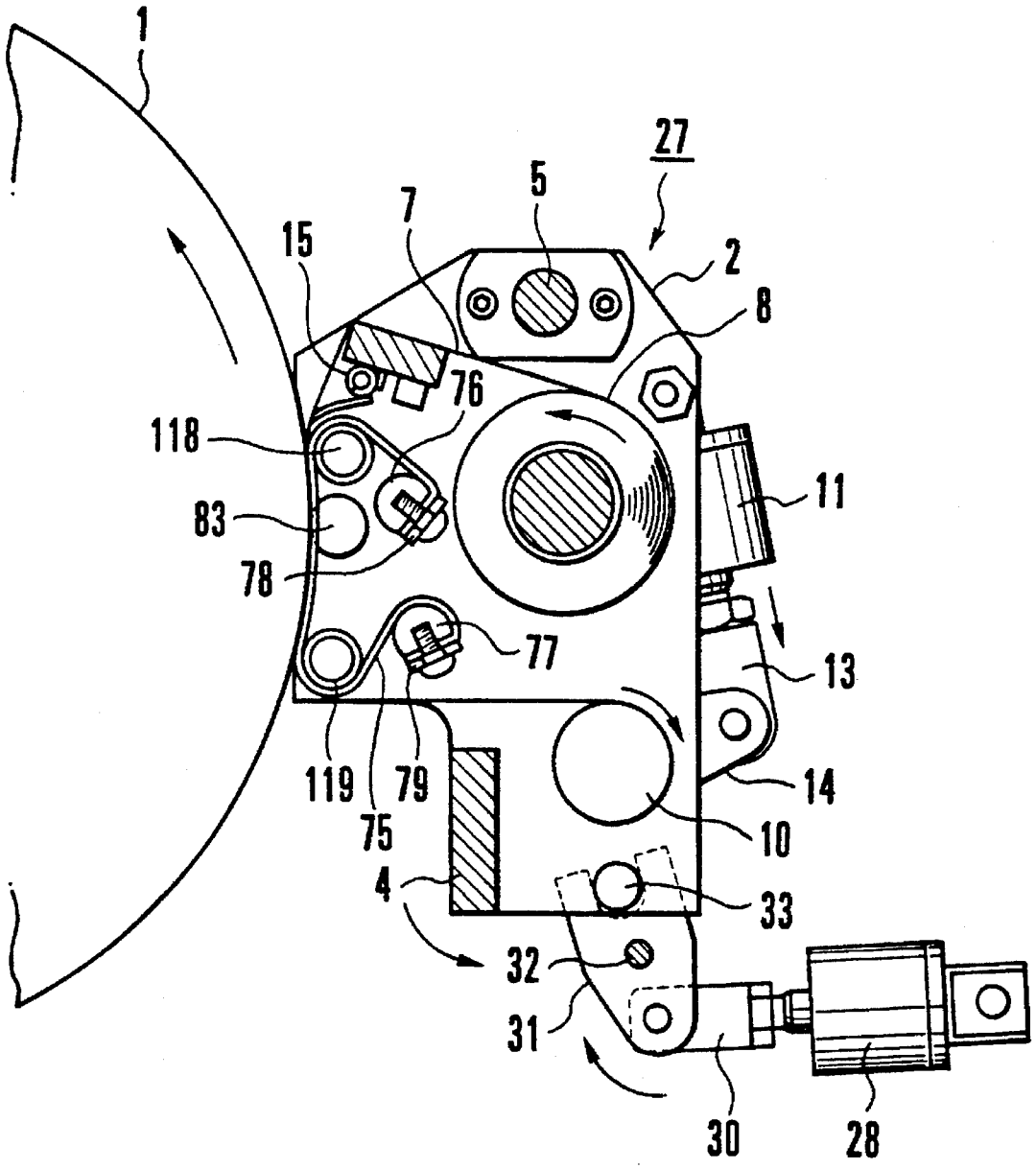
FIG. 12A is a side view showing a cylinder cleaning apparatus for a printing press according to the ninth embodiment of the present invention.
Figure 12B:
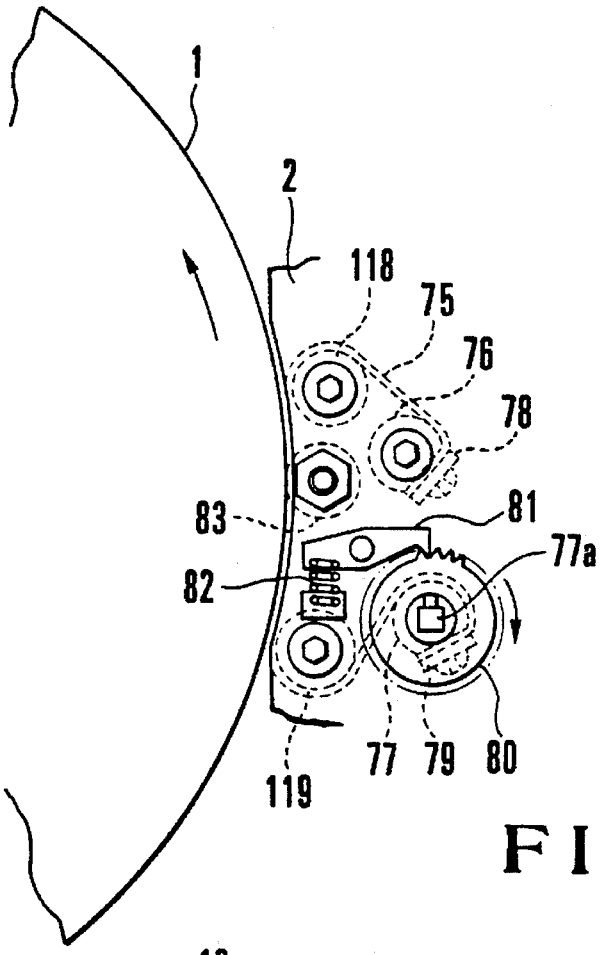
FIG. 12B is a left side view of the main part of the same.
Figure 12C:
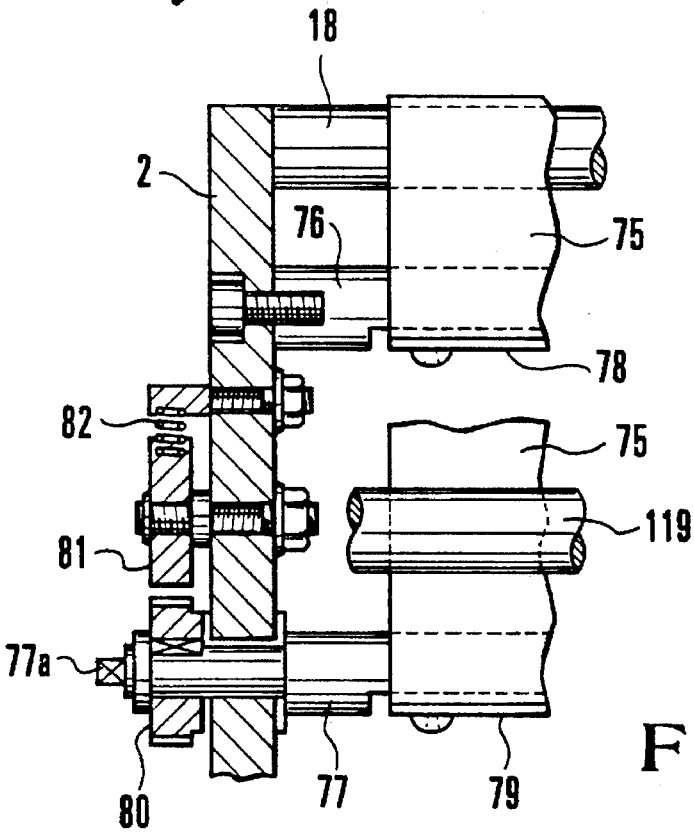
FIG. 12C is a front view of the main part of the same.

FIGS. 12A to 12C show a cylinder cleaning apparatus according to the ninth embodiment of the present invention. The same portions as in FIG. 1 are denoted by the same reference numerals, and a detailed description thereof will be omitted. The characteristic feature of the ninth embodiment resides in that a sheet-like member comprising a rubber sheet 75 is used as a member for pressing a cleaning cloth 7 against a blanket cylinder 1 and that this rubber sheet 75 is stretched over sheet stretch shafts 118 and 119. More specifically, the two ends of the rubber sheet 75 bridged between the sheet stretch shafts 118 and 119 are fixed to the circumferential surfaces of shafts 76 and 77 through screwed metal pads 78 and 79, respectively, and one shaft 76 is fixed to side frames 2. The other shaft 77 is axially pivotally supported on the side frames 2, and a ratchet wheel 80 is axially mounted on the distal end of the shaft 77 so as to be rotatable together with the shaft 77. A ratchet member 81 is biased by a spring 82 toward the circumferential surface gear portion of the ratchet wheel 80 in a direction to mesh with it, thereby regulating the shaft 77 from pivoting counterclockwise in FIG. 12B, i.e., in a direction to flex the rubber sheet 75. Reference numeral 83 denotes rollers abutted against the bearers of the blanket cylinder 1 so that the cleaning cloth 7 is brought into contact with the blanket cylinder 1 at predetermined contact pressure and width.

In the above arrangement, when a prismatic projection 77*a* formed to project at one end of the shaft 77 is pivoted by a tool clockwise in FIG. 12B, the rubber sheet 75 is taken up by the shaft 77 and stretched, and the reverse rotation of the shaft 77 is prevented by engagement of the ratchet wheel 80 and the ratchet member 81, thereby maintaining the stretch state. In this state, when air cylinders 28 are activated to move a cleaning unit 27 until the rollers 83 are abutted against the bearers (not shown), the cleaning cloth 7 is pressed against the circumferential surface of the blanket cylinder 1 by the rubber sheet 75 stretched between the sheet stretch shafts 118 and 119. Then, the cleaning liquid is sprayed from a spray nozzle 15 to the cleaning cloth 7 to clean the blanket cylinder 1. When the rubber sheet 75 presses the cleaning cloth 7 against the circumferential surface of the blanket cylinder 1, since the rubber sheet 75 tends to be easily deformed with the same radius of curvature as that of the circumferential surface of the blanket cylinder 1, the portion of the rubber sheet 75 in tight contact with the circumferential surface of the blanket cylinder 1 is increased. Then, the contact width of the cleaning cloth 7 is increased, and the contact angle thereof is decreased, thereby preventing liquid drops. In this embodiment, if the rollers 83 have eccentric shafts, the projecting amounts of the rollers 83 toward the blanket cylinder 1 can be changed, so that the contact pressure and width of the cleaning cloth 7 can be adjusted.

Figure 13A:
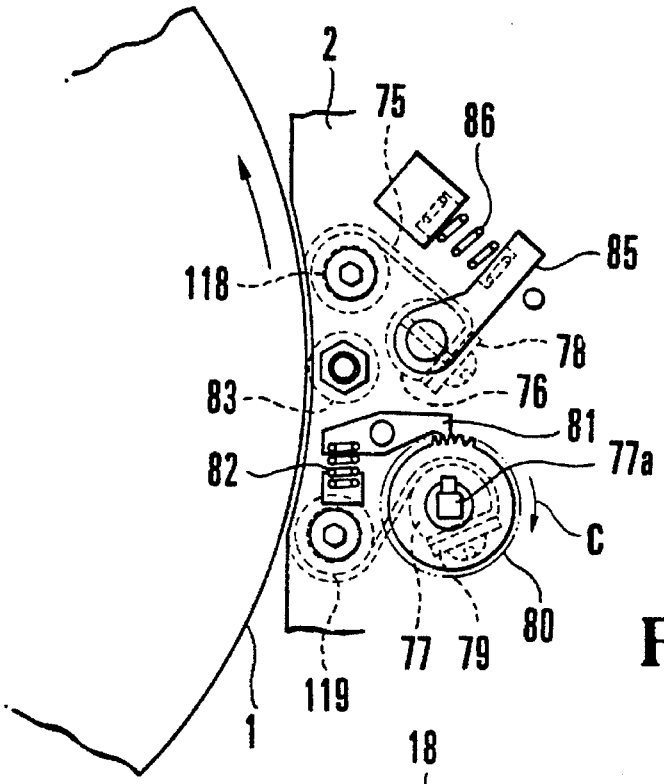
FIG. 13A is a side view showing the main part of a cylinder cleaning apparatus for a printing press according to the tenth embodiment of the present invention.
Figure 13B:
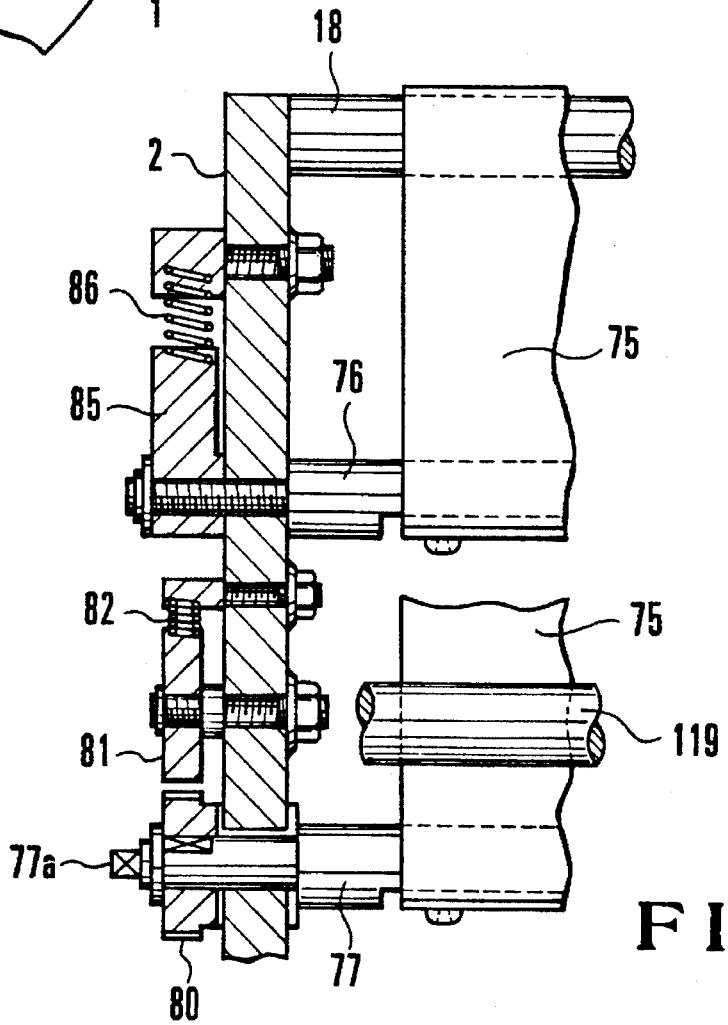
FIG. 13B is a front view of the main part of the same.

FIGS. 13A and 13B show a cylinder cleaning apparatus according to the tenth embodiment of the present invention, in which FIGS. 13A and 13B show the main part of the apparatus. The same portions as in FIG. 1 are denoted by the same reference numerals, and a detailed description thereof will be omitted. In the tenth embodiment, a shaft 76 is pivotally supported by side frames 2. One end of a lever 85 is axially mounted on the end portion of the shaft 76, and the other end of the lever 85 is pressed by a spring 86, thereby imparting a clockwise pivotal tendency to the shaft 76 in a direction indicated by an arrow C in FIG. 13A to take up a rubber sheet 75 stretched between guide shafts 118 and 119. With this arrangement, since a tension is constantly applied to the rubber sheet 75 in a direction to stretch it, the stretched rubber sheet 75 will not flex at the shaft 77 side, and a cleaning cloth 7 is constantly in contact with the circumferential surface of a blanket cylinder 1 at predetermined contact pressure and width.

In this embodiment, the rubber sheet 75 is used as the sheet-like member serving as the pressing member. However, the present invention is not limited to this, and the same effect can be obtained if a cloth, skin, film, or the like is used. The ratchet wheel 80 and the ratchet member 81 are used as the stretching means of the rubber sheet 75. However, the present invention is not limited to them. Worm wheels may be axially mounted on shafts 76 and 77, and worms meshing with the worm wheels may be pivoted. Alternatively, shafts 76 and 77 may not be used, but the two ends of a sheet-like member 75 may be fixed to a pair of brackets coupled to each other by a screw, and the distance between the brackets may be changed by turning the screw. Alternatively, the two ends of a sheet-like member 75 may be directly bonded to each other to constitute an endless member, and this sheet-like member 75 may be pressed from a side surface.

If the two ends of the sheet-like member 75 are fixed to guide shafts 118 and 119, the guide shafts 118 and 119 serve also as shafts 76 and 77, thereby omitting shafts 76 and 77. In this case, the guide shafts 118 and 119 may be set to be pivoted directly so as to serve as the stretching means. The distance between the guide shafts 118 and 119 may be freely adjusted. Various other changes and modifications are possible. The metal pads 78 and 79 are used to fix the sheet-like member 75 to the shafts 76 and 77. However, grooves having recessed portions at their central portions may be formed in the circumferential surfaces of the shafts 76 and 77. The two ends of the sheet-like member 75 may be bent at substantially a right angle, and the bent portions may be directly inserted in and fixed to the grooves.

In all the embodiments described above, the cleaning cloth 7 is used as the cleaning web. However, roll paper may be similarly be used as the cleaning web, and the same effect can be obtained if an unwoven fabric or roll cloth is used. Regarding the cleaning web, various changes and modifications may be made as far as the cleaning liquid or soil on the circumferential surface of the cylinder can be absorbed or wiped off by the cleaning web. The cylinder to be cleaned is not limited to the blanket cylinder 1, but the present invention can naturally be applied to any printing cylinder, e.g., a plate cylinder, an impression cylinder, or a transfer cylinder, or any roller, e.g., a form roller or a vibrating roller, that needs cleaning.

In this embodiment, the air cylinders 11 as a cleaning web drive mechanism are arranged in both the side frames 2. However, an air cylinder may be arranged in either side frame. Similarly, one of the air cylinders 28 serving as the pressing means may be arranged on either side.

As has been described above, according to the present invention, the cleaning web which is brought into slidable contact with the circumferential surface of a cylinder is pressed against the circumferential surface of the cylinder by a flexible plate-like pressing member. Since burst, wear, or air leakage of an expandable member caused by employing compressed air will not occur unlike in the prior art technique, not only a cumbersome repair work is not needed, but also an expensive, complicated structure is not needed, thereby providing an inexpensive, simple structure.

Furthermore, according to the present invention, since stretching means constituted by a sheet-like member is provided to a pressing member for stretching the pressing member, tight contact of the cleaning web with the surface of the cylinder is improved, thereby obtaining a higher cleaning capability.

What is claimed is:

1. A cylinder cleaning apparatus for a printing press, comprising:

a cleaning web, brought into contact with a circumferential surface of a cylinder, for wiping a foreign matter on said circumferential surface of said cylinder;

a flexible plate-like member arranged to oppose said circumferential surface of said cylinder through said cleaning web, said flexible plate-like member is deformed in accordance with a radius of curvature of said circumferential surface of said cylinder when pressed against said circumferential surface of said cylinder, and said plate-like member having a reaction force against said circumferential surface of said cylinder;

pressing means for pressing said cleaning web against said circumferential surface of said cylinder by pressing said plate-like member against said cleaning web;

a holding member for holding said plate-like member in a direction tangent to said circumferential surface of said cylinder, said holding member first, being movable in the direction to come adjacent to said circumferential surface of said cylinder, and second, being movable in the direction to separate from said circumferential surface of said cylinder;

a positioning member for determining a contact position of said plate-like member in a radial direction of said cylinder by abutting against a pair of bearers of said cylinder wherein said positioning member comprises a pair of rollers which are axially supported on said holding member; and an adjusting member, provided in relation to said holding member, for adjusting the contact pressure and width of said plate-like member with respect to said cylinder, the contact point of which is determined by said positioning member, wherein said rollers are a pair of eccentric rollers, and said adjusting member comprises said eccentric rollers which move said plate-like member forward or backward with respect to said circumferential surface of said cylinder, by abutting against said bearer of said cylinder while said cylinder is rotating.

2. A cylinder cleaning apparatus for a printing press, comprising:

a cleaning web, brought into contact with a circumferential surface of a cylinder, for wiping foreign matter on said circumferential surface of said cylinder;

a flexible plate-like member arranged to oppose said circumferential surface of said cylinder through said cleaning web, said flexible plate-like member is deformed in accordance with a radius of curvature of said circumferential surface of said cylinder when pressed against said circumferential surface of said cylinder, and said plate-like member having a reaction force against said circumferential surface of said cylinder;

pressing means for pressing said cleaning web against said circumferential surface of said cylinder by pressing said plate-like member against said cleaning web;

an eccentric roller for determining a contact position of said plate-like member in a radial direction of said cylinder by abutting against a pair of bearers of said cylinder and moving said plate-like member forward or backward with respect to said circumferential surface of said cylinder by being rotated to adjust a contact pressure and width of said plate-like member which is positioned; and a holding member for holding said plate-like member in a direction tangent to said circumferential surface of said cylinder and said eccentric roller, said holding member being movable in a direction to come adjacent to said circumferential surface of said cylinder by using said pressing means.

3. An apparatus according to claim 1, wherein said flexible plate-like member is fixed on one end to said holding member and the other end of said flexible plate-like member is not fixed.

4. An apparatus according to claim 2, wherein said flexible plate-like member is fixed on one end to said holding member and the other end of said flexible plate-like member is not fixed.

* * * * *